United States Patent [19]

Sambayashi

[11] Patent Number: 4,711,559

[45] Date of Patent: Dec. 8, 1987

[54] IMAGE FORMING APPARATUS

[75] Inventor: Takeshi Sambayashi, Oota, Japan

[73] Assignee: Kabushiki Kaisha Toshiba, Kawasaki, Japan

[21] Appl. No.: 925,065

[22] Filed: Oct. 30, 1986

[30] Foreign Application Priority Data

Oct. 31, 1985 [JP] Japan ..... 60-242841

[51] Int. Cl.[4] ..... G03G 15/00

[52] U.S. Cl. ..... 355/14 D; 355/14 E; 355/3 DD

[58] Field of Search ..... 355/3 DD, 14 D, 14 E

[56] References Cited

U.S. PATENT DOCUMENTS 4,659,211 4/1987 Oka ..... 355/14 D

FOREIGN PATENT DOCUMENTS 229036 11/1985 Japan ..... 355/3 DD 263172 12/1985 Japan ..... 355/14 E

*Primary Examiner*—Patrick R. Salce

*Assistant Examiner*—Judson H. Jones

*Attorney, Agent, or Firm*—Cushman, Darby & Cushman

[57] ABSTRACT

An image forming apparatus having first and second development means for developing images to be transcribed on paper sheets in first and second development modes in which image density level changing means is provided for controlling the image density levels by one same manipulation, i.e., in the same direction of image density adjustment, regardless of the development modes. According to the present invention, any erroneous operations by operators can be prevented since the direction of the adjustment for the image density is all the same between the first development mode and second development mode.

8 Claims, 8 Drawing Figures

| LED FOR ON | SWITCH CONTACTS | |
|---|---|---|
| | OPERATION MODE 1 | OPERATION MODE 2 |
| 501 | 0x | 6x |
| 502 | 1x | 5x |
| 503 | 2x | 4x |
| 504 | 3x | 3x |
| 505 | 4x | 2x |
| 506 | 5x | 1x |
| 507 | 6x | 0x |

IMAGE FORMING APPARATUS

BACKGROUND OF THE INVENTION

1. Field of the Invention

The present invention relates to an image forming apparatus, more particularly to an image forming apparatus in which same adjustment of the density of images can be carried out in two different development modes.

2. Description of the Prior Art

It is known that there are two kinds of recorded images of a microfilm i.e., positive and negative images. In order to transcribe the contents of these recorded images onto record media, such as paper sheets as a positive image, two different development modes are required.

The direction of adjustment for the image density differs between the different development modes. For instance, when the adjustment of brightness for an exposure lamp (e.g., a halogen lamp which irradiates a microfilm) is to be performed by image density adjusting means, the image becomes light when the exposure lamp is brightened in one development mode while the image becomes dark when the exposure lamp is brightened in the other development mode. Accordingly, it is desired that the adjustment of image density can be performed by a common operation means in the two different modes.

Actually, however, in order to adjust the brightness of the exposure lamp, mere use of a variable resistor or potentiometer results in the necessity of moving a knob of the variable resistor in the same direction as that of brightness or darkness of the exposure lamp. As a result, the direction of the movement about the knob of the variable resistor becomes opposite to that of the image density between the positive-positive development and the negative-positive development. Consequently, erroneous copies often tend to be made. In addition, there are other disadvantages, such as that its manipulation is not good as user's determination is required for the manipulation at each time.

SUMMARY OF THE INVENTION

It is an object of the present invention, therefore, to provide an image forming apparatus in which the adjustment of the image density can be performed only in one direction regardless of the development modes.

It is another object of the present invention to provide an image forming apparatus in which the adjustment of the image density levels and its indication can be performed in the same manner and in the same direction regardless of the positive-positive development mode or the negative-positive development mode.

One feature of the present invention resides in an image forming apparatus having first and second development means for development images to be transcribed on paper sheets in first and second modes respectively wherein the direction for image density adjustment being opposite each other between the first and second development modes, which comprises: a light source for irradiating images to be transcribed; and image density level changing means for controlling the density levels of images to be transcribed on the paper sheets through the light source by a manupilation of a single same direction regardless of the development modes, thereby preventing any erroneous operations by operators from occuring.

These and other objects, features and advantages of the invention will be better understood from the following description with reference to the accompanying drawings.

DESCRIPTION OF THE PREFERRED EMBODIMENT

Figure 1:
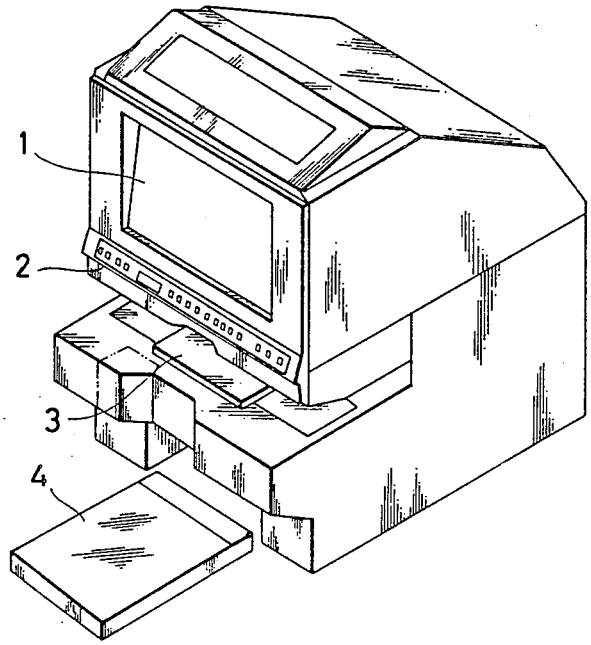
FIG. 1 illustrates an external appearance of an image forming apparatus and a paper sheet cassette, to which the present invention is applied.

FIG. 1 shows a perspective external appearance of the image forming apparatus as a reader printer as one embodiment to which the present invention has been applied.

The reader printer is provided with on its front a projection screen 1 for projecting enlarged images of a microfilm, an operation pannel 2 having different operation keys, and a film holder 3 for holding the microfilm. A paper supplying cassette 4 containing paper sheets to be copied can removably be inserted from the front and the paper sheets on which the contents of the microfilm have been transcribed are ejected on the upper side of an opening for receiving the cassette 4.

Figure 2:
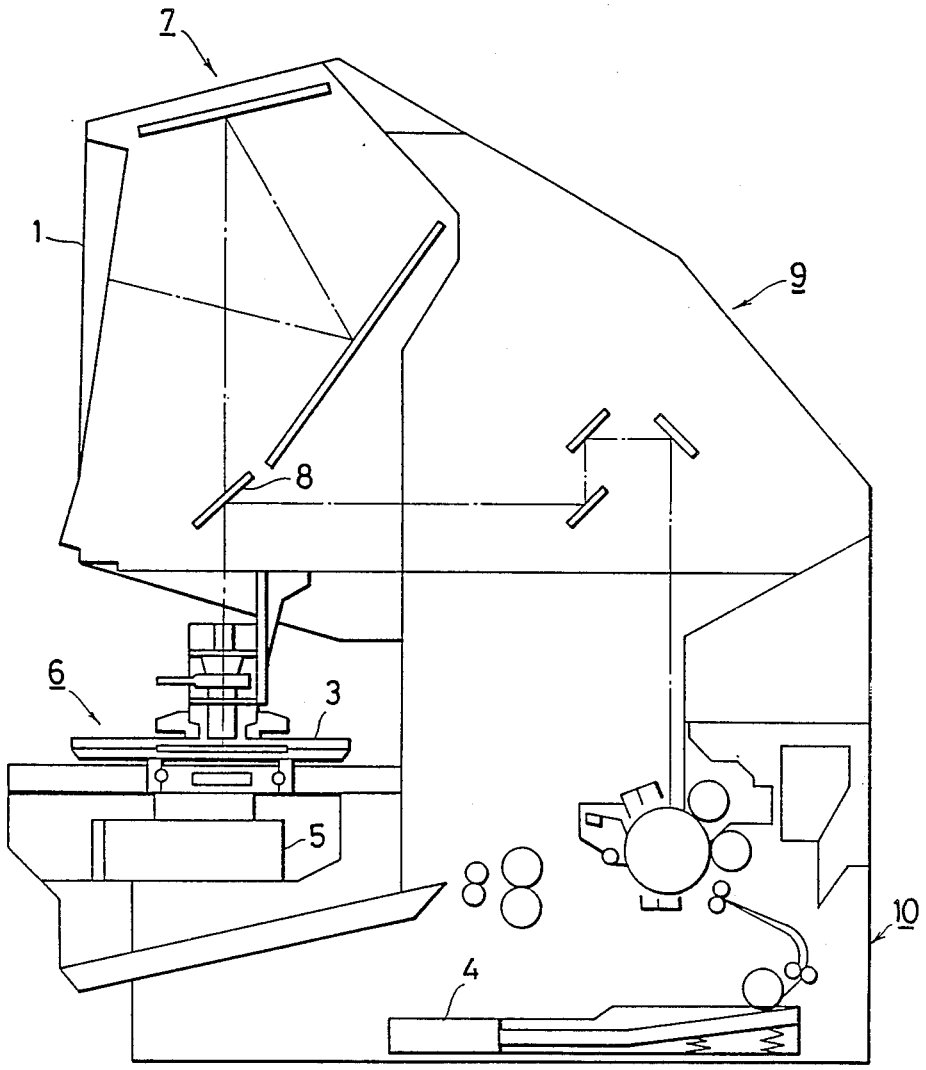
FIG. 2 illustrates an overall inner construction of the image forming apparatus according to the present invention.

As shown in FIG. 2, the reader printer is also provided with a film setting unit 6 having a film holder 3 and a light source 5 for projection, a projection unit 7 for projecting film images on the projection screen 1, a scanning light guide unit 9 for guiding the scanning light obtainable at a pivoting mirror 8 in the projection unit 7 and an image forming unit 10 for forming images to be transcribed on the paper sheets from the cassette in accordance with the scanner light from the guide unit 9.

Figure 3:
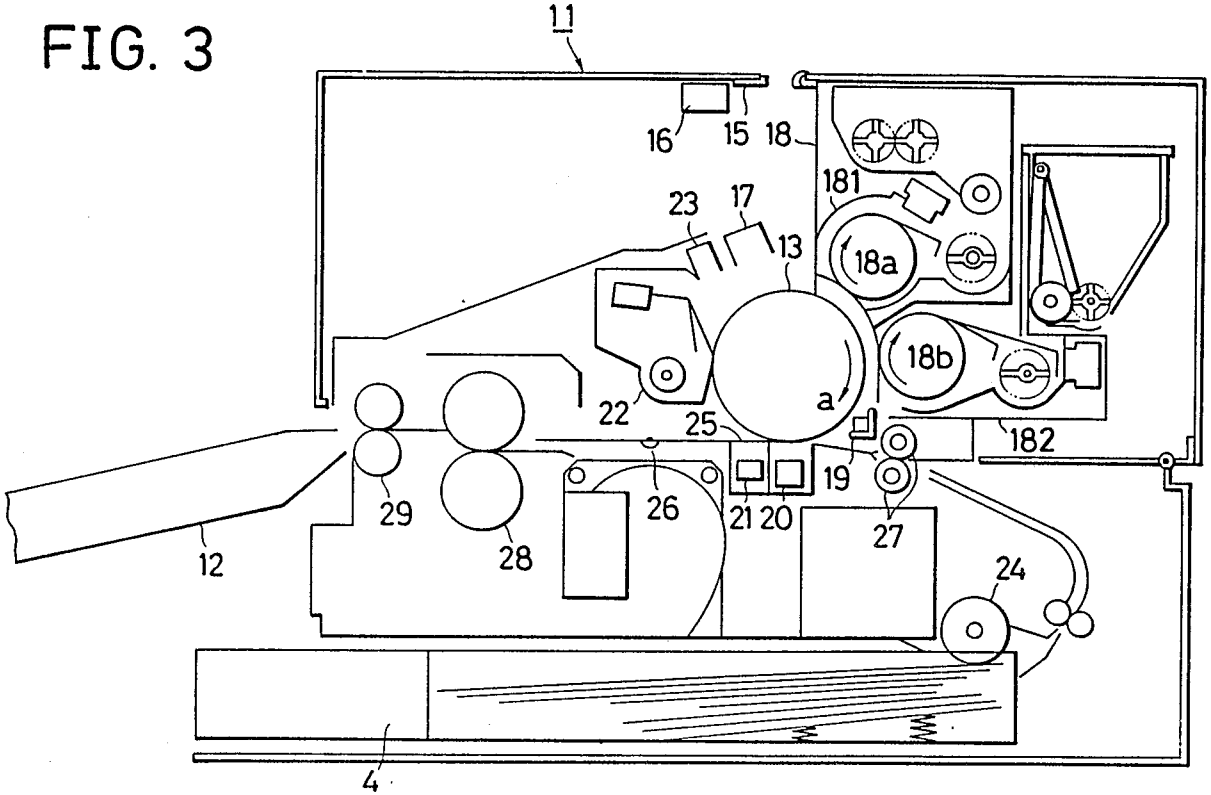
FIG. 3 is a detailed construction of the image forming portion of the image forming apparatus in the form of a reader printer, FIGS. (A) and (B) illustrate one embodiment of image density level changing means according to the present invention.

FIG. 3 shows a detailed construction of the image forming unit 10 having an unit body 11 which can store the paper supplying cassette 4 at the bottom of the body 11 on the front thereof, and a reception 12 for the ejected paper sheets.

A photosensitive drum 13 as an image carrier means is arranged generally at the center of the unit body 11, and a shatter mechanism 15 for interrupting the scanning light from the scanning light guide unit 9 and a solenoid 16 for driving the same are arranged on the upper side of the photosensitive drum 13. Around the photosensitive drum 13, there is provided a charger 17 for charging electric charge, a development means 18, a charge removing means 19 for removing charge before transcription, a charger 20 for transcription, a separation charger 21, a cleaner 22 and a charge removing lamp 23.

At the lower portion of the body 11, there is formed a paper feed path 26 for feeding the paper sheets from the cassette 4, which are automatically picked up through a paper supply roller 24 and for leading them to the paper reception 12 through an image forming portion 25 between the photosensitive drum 13 and the charger 20 for transcription.

A pair of resist rollers 27, 27 are provided upstream of the image forming portion 25 on the paper feed path 26, while a pair of heat rollers 28 as fixing means and a pair of paper ejection rollers 29 are provided downstream thereof.

In operation, when the photosensitive drum 13 is rotated in the direction of arrow a in FIG. 3, it is uniformly charged by the charger 17 and the scanning light from the scanning light guide unit 9 is forcused on the photosensitive drum 13 successively, so as to form an electrostatic latent image thereon. The latent image thus formed is then developed in the development means 18 so as to produce its image and it is transferred to the charger 20 for transcription.

The paper supplied from the paper cassette 4 is applied to the resist rollers 27, 27 and the actual image preliminarily formed on the photosensitive drum 13 is transcribed on the paper sheet by the charger 20 for transcription. The paper sheet on which the image has been transcribed is separated from the photosensitive drum 13 by the separation charger 21 and it is then fed to the heat rollers 28 by way of the paper feed path 26, where the transcribed image is meltingly fixed and is then ejected to the paper reception 12 through the ejection rollers 29. After the transcription of the image onto the paper sheet, the residual image on the drum 13 is erased by a known erasion means for preparation of the next operation.

As shown in FIG. 3, the development means 18 comprises first and second development rollers **18*a* and 18*b*** which are selectively driven so as to develope an image from either a negative microfilm or a positive microfilm as a positive image.

More specifically, the development means 18 is divided into a first development member 181 including a first development roller **18*a* and a second development member 182 including a first development roller 18*b* in such a manner that the first development member 181 performes a positive-positive development while the second development member 182** performs a negative-positive development.

In the development mode for performing the positive-positive development (which is referred to hereafter as P-P development mode), when the exposure light from the light source 5 is increased, the image to be formed on the paper becomes light while when the light from the source 5 is decreased, the image to be formed on the paper becomes dark.

In the development mode for performing the negative-positive development (which is referred to hereinafter as N-P development mode) on the other hand, when the exposure light from the light source 5 is decreased, the image to be formed on the paper becomes light while when the light from the light source 5 is increased, the image to be formed on the paper becomes dark.

Figure 4:
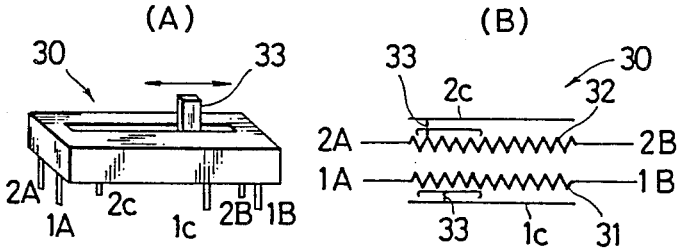

In one embodiment according to the present invention, in order to prevent any erroneous operation from occuring when the adjustment for the image density is performed regardless of the P-P development mod or the N-P development mode, a two-gang variable resistor 30 is provided, as shown in FIGS. 4 (A), and (B). In this two-gang variable resistor, two resistors 31 and 32 arranged in parallel can be commonly operated by a slider 33 in such that the voltage drop across the resistor 31 and that across the resistor 32 are changed in the opposite direction each other.

Figure 5:
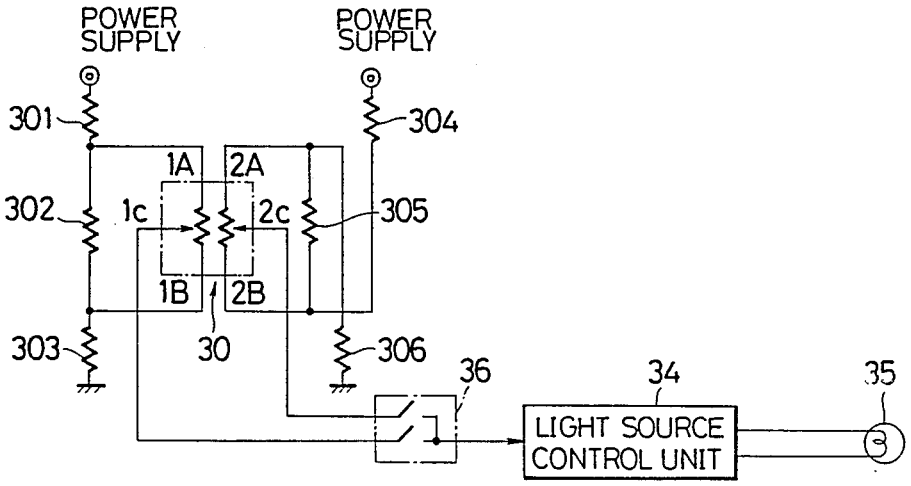
FIG. 5 is its electrical circuit construction having an analog switch for operating the density level changing means.

FIG. 5 shows one embodiment of the adjusting device for the density of images, to which the two-gang variable resistor 30 of FIG. 4 has been applied thereto as density level changing means.

In the figure, the adjusting device comprises the two-gang variable resistor or potentiomenter 30, a light source control unit 34, a lamp 35 as a light source, an analog switch 36, and resistors 301 to 306. In this embodiment, when the slider 33 of the two-gang variable resistor 30 is moved, for instance, in the right direction in FIG. 4 (B), the voltage produced from the tap **1*c* side of the variable resistor 30 is increased while that from the tap 2*c* side of the resistor 30** is decreased.

Accordingly, when the analog switch 36 is constructed and operated in such that either the voltage across the tap **1*c* of the variable resistor 30 or that across the tap 2*c* thereof can be selected by the analog switch 36 corresponding to either one of the development modes selected. The voltage corresponding to the adjustment of the image density is applied to the light source control unit 34 as an input signal. As a result, the light source lamp 35 can be changed accordingly, in the P-P development mode, that is, when the image is desired to be lightened, the lamp 35 is brightened while it is desired to be darkened, it is darkened by the adjustment of the variable resistor 30**.

Likewise, when the image to be transcribed on a paper is desired to be lightened in the N-P development mode, the brightness of the lamp 35 is controlled in the same operation as that in the P-P development mode, i.e. when the image is desired to be lightened, the lamp 35 is darkened while it is desired to be darkened, the lamp 35 is brightened.

In this manner as described above, in the image forming apparatus having the adjustment device, according to the present invention, the density of the images to be transcribed can be controlled by the same adjusting operation regardless of the development modes, so that any errorneous operation or manupilations can be avoided when adjusting the density of images in the image forming apparatus according to the present invention.

Figure 6:
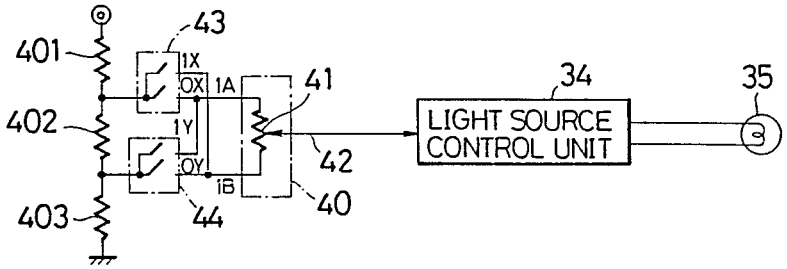
FIG. 6 is a second embodiment of the level changing means according to the present invention, and FIGS. 7 (A) and (B) illustrate respectively a control pannel and a circuit contrust present invention, ion of a third embodiment according to the and FIG. 8 is a relationship between the LEDs to be lighted and the operation modes according to the present invention.

FIG. 6 shows another embodiment of the adjusting device as image density level changing means, according to the present invention. In this embodiment, a single variable resistor or potentiometer 40 is used for adjusting the density of the images to be transcribed, in both the P-P development mode and the N-P development mode.

The single variable resistor 40 is constructed in such a manner that the voltage drop can be picked up between each terminal of the resistor 41 and a slider 42. In order to selectively pick up the voltage drop across the variable resistor 40, two analog switches 43 and 44 are used in this embodiment together with resistors 401 to 403.

With this construction, only the contacts 0X and 0Y are turned on in the P-P development mode, while only the contacts 1X and 1Y are turned on in the N-P development mode. Namely, when the slider 42 of the variable resistor 40 is moved in the direction of the terminal 1A, the contacts 0X and 0Y are turned on, with the result that the voltage picked up by the slider 42 is increased. On the other hand, when the slider 42 of the variable resistor 40 is moved in the direction of the terminal 1B, the contacts 1X and 1Y are turned on and the voltage picked up by the slider 42 is decreased. Accordingly, the brightness or darkness of the lamp 35 is determined by the application of the voltage to the light source control unit as an input signal thereto.

In the manner as described, the density of the images to be transcribed can be controlled by the single variable resistor 40 in the same way, regardless of the P-P development mode or the N-P development mode, in the image forming apparatus according to the present invention.

The description has been made in the foregoing embodiment where mechanically operable variable resistors are used. However, it is also possible to utilize any electronic volume systems or potentiometers.

Figures 7, 8:
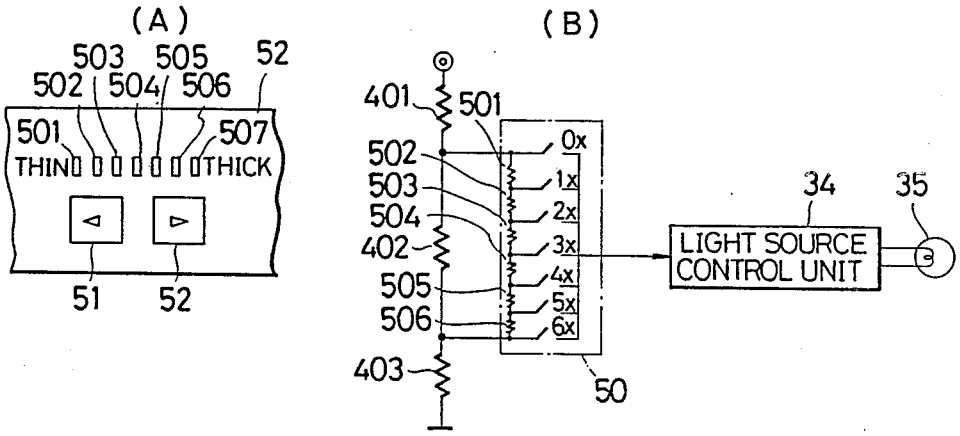

FIG. 7 shows another embodiment of this kind, according to the present invention. Namely, as shown in FIG. 7 (A), the provision is made of image density keys 51 and 52 and image density displaying elements such as light emitting diodes LED 501 to 507 on a control pannel 52 of the image forming apparatus in this embodiment.

The image density key 51 is for selecting the direction of the density of the images from light (thick) to dark (thin) while the image density key 52 is for selecting the direction of the density from dark to light. Namely, the key 51 is operated in such that when it is pushed once, the LED 501 is turned on, when it is pushed twice, the LED 502 is turned on, when it is pushed three times, the LED 503 is turned on, and it continues the like manner.

On the other hand, when the key 52 is pushed once, the LED 501 is turned on, when it pushed twice the LED 502 is turned on, when it is pushed three times the LED 503 is turned on, and it operates the like manner.

FIG. 7 (B) shows its circuit construction for realizing the above operation. The circuit comprises a plurality of analog switches 0X, 1X, 2X, . . . 6X and the corresponding number of the LEDs 501, 502, 503, . . . 507 connected between the adjacent analog switches. The opening and closing operations of the analog switches 0X, 1X, 2X, . . . are interlocked with the pushing operation of the image density switches 51 and 52 in FIG. 7 (A). Namely, when the key 52 is pushed once, the LED 501 is turned on and the analog switch 0X is closed, when it is pushed twice, the LED 502 is turned on and the analog switch 1X is closed, when it is pushed three times the LED 503 is turned on and the analog switch 2X is closed, and it continues so on.

FIG. 8 shows the relationship between the LEDs 501 to 507 to be turned on or lighted and the analog switches to be turned on in accordance with the type of the development modes, i.e., the P-P development mode or the N-P development mode.

With this construction, a microprocessor not shown detects which development mode is being carried out and it selects either the operation mode 1 or the mode 2. Namely, when the P-P development mode is performed, the analog switches 0X to 6X are closed in a predetermined first order, e.g., the mode 1 and the LEDs 501 to 507 are lighted in the gradually increasing order while the N-P development mode is being performed, the analog switches 6X to 0X are closed in a predetermined second order, e.g., the mode 2 and the LEDs 501 to 507 are lighted in the gradually decreasing order. As a result, the direction of the image density and its indication on the control pannel 50 can be carried out commonly, regardless of the types of the development modes.

As described in the foregoing, in the image forming apparatus according to the present invention, since the adjustment of the image density and its indication or display can be performed by the same operation regardless of the different types of the development modes, any erroneous manupilations by users which often occured in the prior art never occur in the image forming apparatus of the invention.

Accordingly, what users should do is to select only the degree of the image density at his choice, regardless of the two different development modes, without the necessity of taking into consideration of the direction of the image density between the two different development modes.

While the invention has been described in its preferred embodiments, it is to be understood that the words which have been used are words of description rather than limitation and that various changes and modifications may be made within the purview of the appended claims without departing in its broader aspects.

What is claimed is:

1. An image forming apparatus for forming electrostatic latent images on an image bearing member by irradiating images from a light souce and developing the electrostatic latent images to form the images on a recording body, which comprises:

first development means for normally developing the electrostatic latent image;

second development means for inversely developing the electrostatic latent image;

mode selecting means for selecting a first mode in which said first development means is used or a second mode in which said second development means is used; and image density level changing means (30,40,50) for controlling the density levels of images to a same level by a same manipulation regardless the development mode selected by said mode selecting means.

2. The image forming apparatus as claimed in claim 1 wherein said image density level changing means comprises:

a two-gang variable resistor (30) having first (31) and second (32) resistors arranged in parallel to a power supply and a slider having two different slidable portions (33, 1C, 2C) along the resistors so as to pick up different potentials between each resistor and each of the slidable portions respectively;

one potential thus picked up being the direction of a gradual increase in one direction while the other potential thus picked up being the direction of a gradual decrease in the same direction; and an analog switch (36) connected between the output terminals of said slidable portions and said light source, responsive to either one of the first or second mode and operable to control the brightness of the light source.

3. The image forming apparatus as claimed in claim 1 wherein said image density level changing means comprises;

a variable resistor (40) having a single slidable portion for picking up a potential from the slidable portion; and a plurality of analog switches (43, 44), each connected to each terminal of said variable resistor and a power supply and operable in accordance with either the first development mode or the second mode, respectively.

4. The image forming apparatus as claimed in claim 1 wherein said image density level changing means comprises:

an analog switch (50) having a plurality of contacts (0X, 1X, 2X, . . . 6X) operable in first and second predetermined order in accordance with the first or second mode; and a plurality of light emitting diodes (501 to 507), each connected between the adjacent contacts of said analog switch and to be lighted on a display pannel; and a plurality of image density keys (51, 52) provided on said display pannel and for selecting the direction of the image density, the operation of said keys being interlocked with the operation of each of the contacts of said analog switch and the operation of each of said light emitting diodes, thereby electronically adjusting and indicating the image density levels by same manipulation regardless of the different modes.

5. An image forming apparatus for forming electrostatic latent images on an image bearing member by irradiating images from a light souce and developing the electrostatic latent images to form the images on a recording body, which comprises:

first development means having first developer for developing the electrostatic latent image;

second development means having second developer with different property from the first developer for developing the electrostatic latent image;

mode selecting means for selecting a first mode in which said first development means is used or a second mode in which said second development means is used; and image density level changing means (30,40,50) for controlling the density levels of images to a same level by a same manipulation regardless the development mode selected by said mode selecting means.

6. The image forming apparatus as claimed in claim 5 wherein said image density level changing means comprises:

a two-gang variable resistor (30) having first (31) and second (32) resistors arranged in parallel to a power supply and a slider having two different slidable portions (33, 1C, 2C) along the resistors so as to pick up different potentials between each resistor and each of the slidable portions respectively;

one potential thus picked up being the direction of a gradual increase in one direction while the other potential thus picked up being the direction of a gradual decrease in the same direction; and an analog switch (36) connected between the output terminals of said slidable portions and said light source, responsive to either one of the first or second mode and operable to control the brightness of the light source.

7. The image forming apparatus as claimed in claim 5 wherein said image density level changing means comprises;

a variable resistor (40) having a single slidable portion for picking up a potential from the slidable portion; and a plurality of analog switches (43, 44), each connected to each terminal of said variable resistor and a power supply and operable in accordance with either the first development mode or the second mode, respectively.

8. The image forming apparatus as claimed in claim 5 wherein said image density level changing means comprises:

an analog switch (50) having a plurality of contacts (0X, 1X, 2X, . . . 6X) operable in first and second predetermined order in accordance with the first or second mode; and a plurality of light emitting diodes (501 to 507), each connected between the adjacent contacts of said analog switch and to be lighted on a display pannel; and a plurality of image density keys (51, 52) provided on said display pannel and for selecting the direction of the image density, the operation of said keys being interlocked with the operation of each of the contacts of said analog switch and the operation of each of said light emitting diodes, thereby electronically adjusting and indicating the image density levels by same manipulation regardless of the different modes.

* * * * *